US008397466B2

(12) United States Patent
Jenkins et al.

(10) Patent No.: US 8,397,466 B2
(45) **Date of Patent: *Mar. 19, 2013**

(54) TILE WITH MULTIPLE-LEVEL SURFACE

(75) Inventors: Mark L. Jenkins, West Valley City, UT (US); Jeremiah Shapiro, West Valley City, WY (US); Cheryl Forster, Salt Lake City, UT (US)

(73) Assignee: Connor Sport Court International, LLC, Salt Lake City, UT (US)

( * ) Notice: Subject to any disclaimer, the term of this patent is extended or adjusted under 35 U.S.C. 154(b) by 553 days.

This patent is subject to a terminal disclaimer.

(21) Appl. No.: 11/244,723

(22) Filed: Oct. 5, 2005
(Under 37 CFR 1.47)

(65) Prior Publication Data

US 2006/0070314 A1 Apr. 6, 2006

Related U.S. Application Data

(60) Provisional application No. 60/616,885, filed on Oct. 6, 2004.

(51) Int. Cl.
*E04B 1/00* (2006.01)
*E04G 21/00* (2006.01)
*E04G 23/00* (2006.01)

(52) U.S. Cl. ..... 52/745.11; 52/180; 52/390; 52/591.1; 52/591.3; 52/177

(58) Field of Classification Search ..... 52/177, 52/180, 384–387, 390, 392, 591.1, 591.2, 52/591.3; D25/163, 156, 157, 158; D6/585
See application file for complete search history.

(56) References Cited

U.S. PATENT DOCUMENTS

| | | | |
|---|---|---|---|
| 321,403 | A | 6/1885 | Underwood |
| 658,868 | A | 10/1900 | Rosenbaum |
| 1,177,231 | A | 3/1916 | Carter |
| 1,425,324 | A | 8/1922 | Kennedy |
| 1,472,956 | A | 11/1923 | Biegler |
| 1,824,571 | A | 5/1927 | Richardson |

(Continued)

FOREIGN PATENT DOCUMENTS

| | | |
|---|---|---|
| CN | 2221623 | 6/1996 |
| EP | 0044371 | 1/1982 |

(Continued)

OTHER PUBLICATIONS

Synthetic Floor Tile, pp. 1-7.

(Continued)

*Primary Examiner* — William Gilbert
*Assistant Examiner* — Chi Q Nguyen
(74) *Attorney, Agent, or Firm* — Thorpe North & Western LLP

(57) ABSTRACT

A grid-top floor tile for outdoor use includes a polymer tile having a grid-type top surface with multiple levels, such as a bi-level surface having an upper lattice and a lower lattice oriented generally transverse to the upper lattice. The multiple levels of the surface are preferably integrally formed with one another and provide drainage gaps therethrough. In a bi-level surface configuration, the lower lattice has a top surface below a top surface of the upper lattice, so as to draw residual moisture below the top surface of the upper lattice. The tile further includes a support structure, configured to support the tile on a support surface and provide drainage pathways beneath the top surface. The tile still further comprises various reinforcement members on each of the loop and pin connectors used to interlock the tiles when forming a flooring assembly.

15 Claims, 7 Drawing Sheets

U.S. PATENT DOCUMENTS

| | | | | |
|---|---|---|---|---|
| 1,896,957 | A | | 2/1933 | Hutcheson |
| 1,971,320 | A | | 8/1934 | Cederquist |
| 2,082,563 | A | | 6/1937 | Bauer |
| 2,225,828 | A | | 12/1940 | Godschall |
| 2,653,525 | A | | 9/1953 | Sargeant |
| 2,680,698 | A | | 6/1954 | Schnee |
| 2,735,166 | A | | 2/1956 | Hoseason |
| 2,810,672 | A | | 10/1957 | Taylor |
| 3,015,136 | A | | 1/1962 | Doe |
| 3,122,073 | A | | 2/1964 | Masse |
| 3,222,834 | A | | 12/1965 | Taft |
| 3,251,076 | A | | 5/1966 | Burke |
| 3,310,906 | A | | 3/1967 | Glukes |
| 3,318,476 | A | | 5/1967 | Clark |
| 3,332,192 | A | | 7/1967 | Kessler et al. |
| 3,350,013 | A | | 10/1967 | Bergquist |
| 3,425,624 | A | | 2/1969 | Jacobs |
| 3,438,312 | A | | 4/1969 | Becker et al. |
| 3,439,312 | A | | 4/1969 | Greasley |
| 3,500,606 | A | | 3/1970 | Wharmby |
| 3,511,001 | A | | 5/1970 | Morgan |
| 3,531,902 | A | | 10/1970 | Costa |
| 3,565,276 | A | | 2/1971 | O'Brien |
| 3,611,609 | A | | 10/1971 | Neljnhard |
| 3,614,915 | A | | 10/1971 | Perry |
| 3,717,247 | A | | 2/1973 | Moore |
| 3,723,233 | A | | 3/1973 | Bourke |
| 3,735,988 | A | | 5/1973 | Palmer et al. |
| 3,736,713 | A | | 6/1973 | Flachbarth et al. |
| 3,775,918 | A | | 12/1973 | Johnson |
| 3,795,180 | A | | 3/1974 | Larsen |
| 3,802,144 | A | * | 4/1974 | Spica ..... 52/591.2 |
| 3,820,912 | A | | 6/1974 | Hughes |
| 3,823,521 | A | | 7/1974 | Heitholt et al. |
| 3,836,075 | A | | 9/1974 | Botbol |
| 3,844,440 | A | | 10/1974 | Hadfield et al. |
| 3,909,996 | A | | 10/1975 | Ettlinger, Jr. et al. |
| 3,911,635 | A | | 10/1975 | Traupe |
| 3,922,409 | A | | 11/1975 | Stark |
| 3,925,946 | A | | 12/1975 | Balinski et al. |
| 3,937,861 | A | | 2/1976 | Zuckerman et al. |
| 3,946,529 | A | | 3/1976 | Chevaux |
| 3,955,836 | A | | 5/1976 | Traupe |
| 4,008,352 | A | | 2/1977 | Dawes et al. |
| 4,008,548 | A | | 2/1977 | Leclerc |
| 4,018,025 | A | | 4/1977 | Collette |
| 4,054,987 | A | | 10/1977 | Forlenza |
| 4,118,892 | A | | 10/1978 | Nakamura et al. |
| 4,133,481 | A | | 1/1979 | Bennett |
| 4,167,599 | A | * | 9/1979 | Nissinen ..... 428/44 |
| D255,744 | S | | 7/1980 | Dekko |
| 4,226,060 | A | | 10/1980 | Sato |
| 4,226,064 | A | | 10/1980 | Kraayenhof |
| 4,244,484 | A | | 1/1981 | Guritz et al. |
| 4,274,626 | A | | 6/1981 | Grosser et al. |
| 4,285,518 | A | | 8/1981 | Pearo |
| 4,287,693 | A | | 9/1981 | Collette |
| 4,338,758 | A | | 7/1982 | Hagbjer |
| 4,361,614 | A | | 11/1982 | Moffitt, Jr. |
| 4,386,138 | A | | 5/1983 | Arbit |
| 4,419,382 | A | | 12/1983 | Sliemers et al. |
| 4,424,968 | A | | 1/1984 | Smith |
| 4,436,779 | A | | 3/1984 | Menconi et al. |
| 4,440,818 | A | | 4/1984 | Buchan et al. |
| D274,948 | S | | 7/1984 | Swanson et al. |
| 4,468,910 | A | | 9/1984 | Morrison |
| 4,478,901 | A | | 10/1984 | Dickens et al. |
| 4,478,905 | A | | 10/1984 | Neely, Jr. et al. |
| 4,497,858 | A | | 2/1985 | Dupont et al. |
| 4,509,930 | A | | 4/1985 | Schweigert et al. |
| 4,526,347 | A | | 7/1985 | McLoughlin |
| 4,541,132 | A | | 9/1985 | Long |
| 4,559,250 | A | | 12/1985 | Paige |
| 4,577,448 | A | | 3/1986 | Howorth |
| 4,584,221 | A | | 4/1986 | Kung |
| 4,590,731 | A | | 5/1986 | DeGooyer |
| 4,596,729 | A | | 6/1986 | Morrison |
| 4,596,731 | A | | 6/1986 | Cudmore et al. |
| D286,575 | S | | 11/1986 | Saunders |
| 4,640,075 | A | | 2/1987 | Nuncio |
| 4,648,592 | A | | 3/1987 | Harinishi |
| 4,650,180 | A | | 3/1987 | Blondel |
| 4,650,188 | A | | 3/1987 | Schroeder |
| 4,681,482 | A | | 7/1987 | Arciszewski et al. |
| 4,681,786 | A | | 7/1987 | Brown |
| 4,694,627 | A | | 9/1987 | Omholt |
| 4,702,048 | A | | 10/1987 | Millman |
| 4,715,743 | A | | 12/1987 | Schmanski |
| 4,727,697 | A | | 3/1988 | Vaux |
| 4,728,468 | A | * | 3/1988 | Duke ..... 261/111 |
| 4,749,302 | A | | 6/1988 | DeClute |
| 4,766,020 | A | | 8/1988 | Ellingson, Jr. |
| 4,807,412 | A | | 2/1989 | Frederiksen |
| 4,819,932 | A | | 4/1989 | Trotter |
| 4,826,351 | A | | 5/1989 | Haberhauer et al. |
| 4,849,267 | A | | 7/1989 | Ward et al. |
| 4,860,510 | A | | 8/1989 | Kotler |
| 4,875,800 | A | | 10/1989 | Hicks |
| 4,877,672 | A | | 10/1989 | Shreiner |
| 4,917,532 | A | | 4/1990 | Haberhauer et al. |
| 4,930,286 | A | | 6/1990 | Kotler |
| 4,948,116 | A | | 8/1990 | Vaux |
| 4,963,054 | A | | 10/1990 | Hayashi |
| 4,964,751 | A | | 10/1990 | Rope et al. |
| 4,973,505 | A | | 11/1990 | Bielous |
| 5,022,200 | A | | 6/1991 | Wilson et al. |
| 5,039,365 | A | | 8/1991 | Rutledge et al. |
| 5,048,448 | A | | 9/1991 | Yoder |
| 5,052,158 | A | | 10/1991 | D'Luzansky |
| 5,111,630 | A | | 5/1992 | Munsey et al. |
| D327,748 | S | | 7/1992 | Dorfman, Jr. |
| 5,143,757 | A | | 9/1992 | Skinner |
| 5,157,804 | A | | 10/1992 | Williams |
| 5,160,215 | A | | 11/1992 | Jensen |
| 5,185,193 | A | | 2/1993 | Phenicie et al. |
| 5,190,799 | A | | 3/1993 | Ellingson |
| 5,195,288 | A | | 3/1993 | Penczak |
| 5,205,091 | A | | 4/1993 | Brown |
| 5,205,092 | A | | 4/1993 | Taylor |
| 5,215,802 | A | | 6/1993 | Kaars Sijpsteijin |
| 5,228,253 | A | | 7/1993 | Wattelez |
| 5,229,437 | A | | 7/1993 | Knight |
| 5,234,738 | A | | 8/1993 | Wolf |
| 5,250,340 | A | | 10/1993 | Bohnhoff |
| 5,253,464 | A | | 10/1993 | Nilsen |
| 5,295,341 | A | | 3/1994 | Kajiwara |
| 5,303,669 | A | | 4/1994 | Szekely |
| 5,323,575 | A | * | 6/1994 | Yeh ..... 52/177 |
| 5,333,423 | A | | 8/1994 | Propst |
| 5,342,141 | A | | 8/1994 | Close |
| 5,364,204 | A | | 11/1994 | MacLeod |
| 5,365,710 | A | | 11/1994 | Randjelovic |
| 5,379,557 | A | | 1/1995 | Kotter |
| 5,387,842 | A | | 2/1995 | Roth et al. |
| 5,403,453 | A | | 4/1995 | Roth et al. |
| 5,403,637 | A | | 4/1995 | Pickard et al. |
| 5,412,917 | A | | 5/1995 | Shelton |
| 5,414,324 | A | | 5/1995 | Roth et al. |
| 5,418,036 | A | | 5/1995 | Tokikawa et al. |
| 5,449,246 | A | | 9/1995 | Housley |
| 5,456,972 | A | | 10/1995 | Roth et al. |
| 5,462,771 | A | | 10/1995 | Motoki et al. |
| 5,466,424 | A | | 11/1995 | Kusano et al. |
| 5,466,489 | A | | 11/1995 | Stahl |
| 5,502,148 | A | | 3/1996 | Hentschel et al. |
| 5,509,244 | A | | 4/1996 | Bentzon |
| 5,511,353 | A | | 4/1996 | Jones |
| 5,518,799 | A | | 5/1996 | Finestone et al. |
| 5,526,619 | A | | 6/1996 | Vagedes |
| 5,527,128 | A | | 6/1996 | Rope et al. |
| 5,542,221 | A | | 8/1996 | Streit et al. |
| 5,567,490 | A | | 10/1996 | Papazian et al. |
| 5,573,715 | A | | 11/1996 | Adams et al. |
| D377,398 | S | | 1/1997 | Adam |
| 5,616,389 | A | | 4/1997 | Blatz |
| 5,628,160 | A | | 5/1997 | Kung |
| 5,634,309 | A | | 6/1997 | Polen |

5,640,821 A 6/1997 Koch
5,642,592 A 7/1997 Andres
5,647,184 A 7/1997 Davis
5,679,385 A 10/1997 Adams et al.
5,682,724 A 11/1997 Randjelovic
5,693,390 A 12/1997 Inagaki et al.
5,693,395 A 12/1997 Wine
5,695,064 A 12/1997 Huang et al.
5,713,175 A 2/1998 Mitchell
5,713,806 A 2/1998 Teitgen et al.
5,735,096 A 4/1998 Krass
5,749,787 A 5/1998 Jank
5,758,467 A 6/1998 Snear et al.
5,761,867 A 6/1998 Carling
5,787,654 A 8/1998 Drost
5,803,973 A 9/1998 Szczyrbowski et al.
5,815,995 A 10/1998 Adam
5,816,010 A 10/1998 Conn
5,816,738 A 10/1998 Harnapp
5,819,491 A 10/1998 Davis
5,820,294 A 10/1998 Baranowski
5,822,828 A 10/1998 Berard et al.
5,833,386 A 11/1998 Rosan et al.
5,848,856 A 12/1998 Bohnhoff
5,865,007 A 2/1999 Bowman et al.
5,899,038 A 5/1999 Stroppiana
5,904,021 A 5/1999 Fisher
5,906,082 A 5/1999 Counihan
5,906,454 A 5/1999 Medico et al.
5,907,934 A 6/1999 Austin
5,910,401 A 6/1999 Anderson et al.
5,937,602 A 8/1999 Jalbert
5,950,378 A 9/1999 Council et al.
D415,581 S 10/1999 Bertolini
5,992,106 A 11/1999 Carling et al.
6,017,577 A 1/2000 Hostettler et al.
6,032,428 A 3/2000 Rosan et al.
6,044,598 A 4/2000 Elsasser et al.
6,047,663 A * 4/2000 Moreau et al. ..... 119/529
6,068,908 A 5/2000 Kessler et al.
6,095,718 A 8/2000 Bohnhoff
6,098,354 A 8/2000 Skandis
6,101,778 A 8/2000 Martensson
6,112,479 A 9/2000 Andres
6,128,881 A 10/2000 Bue et al.
6,134,854 A 10/2000 Stanchfield
D435,122 S 12/2000 Ross et al.
6,171,015 B1 1/2001 Barth et al.
D437,427 S 2/2001 Shaffer
6,189,289 B1 2/2001 Quaglia et al.
6,228,433 B1 5/2001 Witt
6,230,460 B1 5/2001 Huyett
6,231,939 B1 5/2001 Shaw et al.
6,286,272 B1 9/2001 Sandoz
6,301,842 B1 10/2001 Chaney et al.
6,302,803 B1 10/2001 Barlow
6,321,499 B1 11/2001 Chuang
6,324,796 B1 12/2001 Heath
6,345,483 B1 2/2002 Clark
6,355,323 B1 3/2002 Iwen et al.
D456,533 S 4/2002 Moller, Jr.
6,397,543 B1 6/2002 Hamar
6,418,683 B1 7/2002 Martensson et al.
6,428,870 B1 * 8/2002 Bohnhoff ..... 428/44
6,436,159 B1 8/2002 Safta et al.
6,451,400 B1 9/2002 Brock et al.
6,453,632 B1 9/2002 Huang
6,467,224 B1 * 10/2002 Bertolini ..... 52/177
6,526,705 B1 3/2003 MacDonald
6,531,203 B2 3/2003 Kessler et al.
6,543,196 B1 4/2003 Gonzales
6,562,414 B2 5/2003 Carling
6,578,324 B2 6/2003 Kessler et al.
6,585,449 B2 7/2003 Chen
6,588,166 B2 7/2003 Martensson et al.
6,605,333 B2 8/2003 Ferreira et al.
6,606,834 B2 8/2003 Martensson et al.
6,617,009 B1 9/2003 Chen et al.
D481,138 S 10/2003 Foster et al.
D481,470 S 10/2003 Moller, Jr.
6,637,163 B2 10/2003 Thibault et al.
6,669,572 B1 12/2003 Barlow
6,672,970 B2 1/2004 Barlow
6,672,971 B2 1/2004 Barlow
6,682,254 B1 1/2004 Olofsson et al.
D486,592 S 2/2004 Hong
6,684,582 B2 2/2004 Peart et al.
6,684,592 B2 2/2004 Martin
6,695,527 B2 2/2004 Seaux et al.
6,718,714 B1 4/2004 Montgomery
6,718,715 B2 4/2004 Elliott
6,736,569 B2 5/2004 Lee
6,739,797 B1 5/2004 Schneider
D492,426 S 6/2004 Strickler
6,751,912 B2 6/2004 Stegner et al.
6,769,219 B2 8/2004 Schwitte et al.
6,793,586 B2 9/2004 Barlow et al.
6,802,159 B1 * 10/2004 Kotler ..... 52/177
6,820,386 B2 11/2004 Kappeli et al.
6,833,038 B2 12/2004 Iwen et al.
6,851,236 B1 2/2005 Harvey
6,878,430 B2 4/2005 Milewski et al.
6,880,307 B2 4/2005 Schwitte et al.
6,895,881 B1 5/2005 Whitaker
6,931,808 B2 8/2005 Hamar
6,962,463 B2 11/2005 Chen
7,021,012 B2 4/2006 Zeng et al.
7,029,744 B2 4/2006 Horstman et al.
D522,149 S 5/2006 Shin
7,047,697 B1 5/2006 Heath
7,065,935 B2 6/2006 Ralf
7,090,430 B1 8/2006 Fletcher et al.
7,096,632 B2 8/2006 Pacione
7,114,298 B2 * 10/2006 Kotler ..... 52/177
7,127,857 B2 10/2006 Randjelovic
D532,530 S 11/2006 Shuman et al.
7,131,788 B2 11/2006 Ianniello et al.
7,144,609 B2 12/2006 Reddick
7,155,796 B2 1/2007 Cook
7,211,314 B2 5/2007 Nevison
7,299,592 B2 11/2007 Moller, Jr.
7,303,800 B2 12/2007 Togers
7,340,865 B2 3/2008 Vanderhoef
7,383,663 B2 6/2008 Pacione
7,386,963 B2 6/2008 Pervan
7,412,806 B2 8/2008 Pacione et al.
7,464,510 B2 12/2008 Scott et al.
7,516,587 B2 4/2009 Barlow
7,520,948 B2 4/2009 Tavy et al.
D593,220 S 5/2009 Reed
7,527,451 B2 5/2009 Slater
7,531,055 B2 5/2009 Mead
7,563,052 B2 7/2009 Van Reijen
7,571,572 B2 8/2009 Moller, Jr.
7,571,573 B2 8/2009 Moller
7,587,865 B2 9/2009 Moller, Jr.
RE41,140 E 2/2010 Heath
D611,626 S 3/2010 Arden
7,676,291 B2 3/2010 Gettig
7,704,011 B2 4/2010 Marshall
7,748,176 B2 7/2010 Harding et al.
7,748,177 B2 7/2010 Jenkins et al.
7,900,416 B1 3/2011 Yokubison et al.
7,950,191 B2 5/2011 Brouwers
2001/0002523 A1 6/2001 Chen
2002/0071927 A1 6/2002 Kessler et al.
2002/0152702 A1 10/2002 Tseng
2002/0189176 A1 * 12/2002 Stegner et al. ..... 52/177
2003/0009971 A1 1/2003 Palmberg
2003/0093964 A1 5/2003 Bushey et al.
2003/0148813 A1 8/2003 Barlow
2003/0190969 A1 10/2003 Barlow et al.
2004/0023006 A1 2/2004 Mead
2004/0035079 A1 2/2004 Evjen
2004/0182030 A1 9/2004 Hinault et al.
2004/0235580 A1 11/2004 Barlow et al.
2004/0258869 A1 12/2004 Walker
2005/0016098 A1 1/2005 Hahn

| | | | |
|---|---|---|---|
| 2005/0028475 | A1 | 2/2005 | Barlow et al. |
| 2005/0144867 | A1 | 7/2005 | Clarke |
| 2005/0193670 | A1 | 9/2005 | Niese et al. |
| 2005/0202208 | A1 | 9/2005 | Kelly |
| 2005/0204676 | A1 | 9/2005 | Weitzer |
| 2005/0252109 | A1 | 11/2005 | Fuccella et al. |
| 2006/0070314 | A1 | 4/2006 | Jenkins |
| 2006/0080909 | A1 | 4/2006 | Harding et al. |
| 2006/0265975 | A1 | 11/2006 | Geffe |
| 2006/0272252 | A1 | 12/2006 | Moller, Jr. |
| 2006/0285920 | A1 | 12/2006 | Gettig et al. |
| 2007/0214741 | A1 | 9/2007 | Llorens Miravet |
| 2007/0289244 | A1 | 12/2007 | Haney et al. |
| 2008/0092473 | A1 | 4/2008 | Heyns |
| 2008/0127593 | A1 | 6/2008 | Janesky |
| 2008/0168736 | A1 | 7/2008 | Pervan |
| 2008/0172968 | A1 | 7/2008 | Pacione |
| 2008/0216437 | A1 | 9/2008 | Prevost et al. |
| 2008/0271410 | A1 | 11/2008 | Matthee |
| 2008/0295437 | A1 | 12/2008 | Dagger |
| 2009/0031658 | A1 | 2/2009 | Moller, Jr. et al. |
| 2009/0049768 | A1 | 2/2009 | Kim |
| 2009/0139160 | A1 | 6/2009 | Hill |
| 2009/0235605 | A1 | 9/2009 | Haney |
| 2010/0236176 | A1 | 9/2010 | Jenkins |
| 2011/0045916 | A1 | 2/2011 | Casimaty et al. |

FOREIGN PATENT DOCUMENTS

| | | |
|---|---|---|
| EP | 1167652 | 1/2002 |
| FR | 2240320 | 3/1975 |
| GB | 1504811 | 3/1978 |
| GB | 2262437 | 12/1991 |
| GB | 2263644 A | 8/1993 |
| GB | 2353543 | 10/2000 |
| JP | 01-226978 | 9/1989 |
| KR | 20-0239521 | 10/2001 |
| KR | 10-2006-0127635 | 12/2006 |
| WO | WO92-01130 | 1/1992 |

OTHER PUBLICATIONS

Synthetic Floor Tile, pp. 8-12.
Synthetic Floor Tile, pp. 13-17.
Synthetic Floor Tile, pp. 18-21.
Synthetic Floor Tile, p. 22.
Synthetic Floor Tile, pp. 23-27.
Synthetic Floor Tile, pp. 28-32.
Synthetic Floor Tile, pp. 33-37.
Synthetic Floor Tile, pp. 38-42.
Synthetic Floor Tile, pp. 43-47.
Synthetic Floor Tile, pp. 48-52.
Synthetic Floor Tile, pp. 53-57.
Synthetic Floor Tile, pp. 58-62.
Synthetic Floor Tile, pp. 63-67.
Synthetic Floor Tile, pp. 68-72.
Synthetic Floor Tile, pp. 73-77.
Synthetic Floor Tile, pp. 78-82.
Synthetic Floor Tile, pp. 83-87.
Synthetic Floor Tile, pp. 88-92.
Synthetic Floor Tile, pp. 93-97.
Synthetic Floor Tile, pp. 98-102.
Synthetic Floor Tile, pp. 103-107.
Synthetic Floor Tile, pp. 108-112.
Synthetic Floor Tile, pp. 113-117.
Synthetic Floor Tile, pp. 118-122.
Synthetic Floor Tile, pp. 123-127.
Synthetic Floor Tile, pp. 128-133.
Synthetic Floor Tile, pp. 134-138.
Synthetic Floor Tile, pp. 139-143.
Synthetic Floor Tile, pp. 144-148.
Synthetic Floor Tile, pp. 149-153.
Synthetic Floor Tile, pp. 154-159.
Synthetic Floor Tile, pp. 160-164.
Synthetic Floor Tile, pp. 165-169.
Synthetic Floor Tile, pp. 170-174.
Synthetic Floor Tile, pp. 175-179.
Synthetic Floor Tile, pp. 180-184.
Synthetic Floor Tile, pp. 185-189.
Synthetic Floor Tile, pp. 190-194.
Synthetic Floor Tile, pp. 195-199.
Synthetic Floor Tile, pp. 200-204.
Synthetic Floor Tile, pp. 205-209.
Synthetic Floor Tile, pp. 210-214.
Synthetic Floor Tile, pp. 215-219.
Synthetic Floor Tile, pp. 220-224.
SSynthetic Floor Tile, pp. 225-229.
Synthetic Floor Tile, pp. 230-234.
Synthetic Floor Tile, pp. 235-239.
Synthetic Floor Tile, pp. 240-244.
Synthetic Floor Tile, pp. 245-249.
Synthetic Floor Tile, pp. 250-254.
Haney, Thayne et al., U.S. Appl. No. 11/732,714, filed Apr. 3, 2007.
Jenkins, Mark et al, U.S. Appl. No. 29/263,675, filed Jul. 26, 2006.
Haney, Thayne et al., U.S. Appl. No. 12/340,555, filed Dec. 19, 2008.
"Standard Test Method for Relative Abrasiveness of Synthetic Turf Playing Surfaces"; Copyright ASTM International; Jul. 10, 2003.
"Standard Test Method for Abrasion Resistance of Textile Fabrics (Rotary Platform, Double-Head Method)"; Copy right by ASTM; Jan. 15, 2009.
www.polypavement__com__contactus.
www.arplastsrl.com website, 1 page.
www.invisiblestructures.com webiste Jul. 26, 2006, 109 pages.
www.mateflex.stores.yahoo.net websiter Jul. 26, 2006, 68 pages.
www.namintec.com, website, Jul. 26, 2006, 28 pages.
www.polypavement.com/costs.htm, website Mar. 24, 2006, pp. 1-2.
www.polypavement.com/more__info.htm, website Mar. 24, 2006 pp. 1-12.
www.polypavement.com/index.htm, website Mar. 24, 2006, pp. 1-6.
PCT Application PCT/US2011/022802; filed Jan. 28, 2011; Ronald N. Cerny; International Search Report mailed Sep. 28, 2011.
Synthetic Floor Tile; 88 pages.
Inter Partes Reexamination for Patent No. 7,748,177; Request filed Dec. 29, 2011; 192 pages.
U.S. Appl. No. 95/000,651, filed Dec. 29, 2011; office action issued Feb. 3, 2012.
Affidavit of Christopher Butler; signed Jan. 24, 2011; received by Thorpe North and Western on Jul. 8, 2011; 13 pages.

* cited by examiner

TILE WITH MULTIPLE-LEVEL SURFACE

RELATED APPLICATIONS

This application relates to U.S. Provisional Patent Application No. 60/616,885, filed Oct. 6, 2004, and entitled, "Tile with Bi-Level Grid Surface," which is incorporated by reference in its entirety herein.

FIELD OF THE INVENTION

The present invention relates generally to floor tile systems, such as sport floor systems. More particularly, the present invention relates to an interlocking floor tile having a top surface comprised of multiple levels, such as a bi-level surface.

BACKGROUND OF THE INVENTION AND RELATED ART

Numerous types of flooring have been used to create multi-use surfaces for sports, as well as for other purposes. In recent years, the use of modular flooring assemblies made of synthetic materials has grown in popularity. Modular flooring systems generally comprise a series of interlocking tiles that can be permanently installed over a support base or subfloor, such as concrete or wood, or temporarily laid down upon another surface from time to time when needed. These floors and floor systems can be used both indoors or outdoors.

Such synthetic floors are advantageous for several reasons. One reason for the popularity of these types of systems is that they are typically formed of materials that are generally inexpensive and lightweight. Additionally, if one tile becomes damaged, it can be removed and replaced quickly and easily. If the flooring needs to be temporarily removed, the individual tiles making up the floor can easily be detached and stored for subsequent use. Another reason for the popularity of these types of flooring assemblies is that the durable plastics from which they are formed are long-lasting, even in outdoor installations. Also, unlike some other long-lasting alternatives, such as asphalt and concrete, interlocking tiles are generally better at absorbing impact, and there is less risk of injury if a person falls on the synthetic material, as opposed to concrete or asphalt. Moreover, the connections for modular flooring assemblies can be specially engineered to absorb any applied forces, such as lateral forces, which can reduce certain types of injuries from athletic activities. Additionally, these flooring assemblies generally require little maintenance as compared to other flooring, such as wood.

Modular flooring assemblies for outdoor use present certain unique requirements. One of the most important is provision for drainage of water. It will be apparent that water standing on the surface of a polymer floor tile can create a slippery and potentially dangerous condition. To allow drainage of water away from the tiles and prevent a slippery surface, outdoor flooring systems or assemblies generally have a grid-type top surface, rather than a solid surface, and discontinuous upright supports (e.g. upright posts, rather than continuous walls) beneath. A grid surface provides a random or patterned series of openings that allow water to drain down through the tile, while the upright supports provide channels below the tile surface that allow the water to drain away.

Unfortunately, these general design features are somewhat deficient in solving the problems inherent in outdoor modular tiles. For example, challenges related to traction on the top surface still remain. Drops of water can still adhere to the top of the grid surface, creating slippery conditions, notwithstanding the provision for drainage through the tile. Because of surface tension, drops of water can also be suspended in the drainage openings, thus increasing the time that it takes for the tiles within the flooring assembly to dry. Moreover, polymer materials that have adequate strength and durability for use in outdoor sport floors tend to become smooth with age and wear, thus providing less traction for users. Conversely, polymer materials that provide better traction, even with wear (such as those with higher rubber content), generally do not have sufficient strength and durability characteristics for forming such flooring assemblies. Additionally, if the grid openings of the top surface are too large, leaves, tree seeds, and other debris can fall through the openings and clog the drainage pathways. The prior art has not adequately addressed these problems.

SUMMARY OF THE INVENTION

It has been recognized that it would be advantageous to provide an improved floor tile for use in flooring assemblies or systems configured particularly for outdoor use that more adequately addresses the problems inherent in prior related floor tiles, such as improved drainage and channeling of water away from the top surface of the floor tile.

It would also be advantageous to provide the outdoor floor tile with improved traction characteristics for users without compromising the strength and durability of the tiles.

It would still further be advantageous to provide the outdoor floor tile with openings that are configured to facilitate adequate and improved water drainage over prior related floor tiles, while also preventing debris from clogging the drainage pathways.

Additional features and advantages of the invention will be apparent from the detailed description which follows, taken in conjunction with the accompanying drawings, which together illustrate, by way of example, features of the invention.

Therefore, in accordance with the invention as embodied and broadly described herein, the present invention features a floor tile having a multiple-level surface configuration, such as a bi-level or tri-level surface configuration. More specifically, the present invention features a synthetic floor tile for use within a floor assembly comprising: (a) a perimeter wall defining a perimeter boundary of the floor tile; (b) a surface contained at least partially within the perimeter wall, the surface comprising multiple levels; and (c) a support structure configured to support the surface.

The present invention also features a synthetic floor tile configured for use with a flooring assembly, the synthetic floor tile comprising: (a) a grid-type top surface, having an upper lattice, and a lower lattice, wherein the lower lattice is oriented generally transverse to the upper lattice, and the upper and lower lattices are integrally formed and provide drainage gaps therethrough, the lower lattice comprising a top surface that is located below a top surface of the upper lattice, so as to draw residual moisture from the top surface of the upper lattice.

The present invention further features a synthetic floor tile comprising: (a) a perimeter wall enclosing a perimeter boundary for the tile; (b) a top surface having an upper lattice that forms a grid extending within the perimeter wall, and a lower lattice, also forming a grid extending within the perimeter wall, the lower lattice being oriented generally transverse to the upper lattice, the upper and lower lattices being integrally formed to provide drainage gaps therethrough.

The present invention still further features an outdoor activity court comprising: (a) a support floor; (b) a plurality of synthetic tiles disposed atop the support floor and interconnected with one another to provide a flooring assembly, the plurality of synthetic tiles comprising: (i) a surface comprising multiple levels integrally formed with one another to provide drainage gaps therethrough; and (ii) a support structure configured to support the surface on the support floor.

The present invention still further features a method for facilitating the removal and drawing of water from a flooring assembly comprising: (a) configuring a plurality of synthetic floor tiles with a surface comprising multiple levels, each being integrally formed with one another to provide drainage gaps therethrough; and (b) facilitating the interconnection of the plurality of synthetic floor tiles to form a flooring assembly.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

DETAILED DESCRIPTION OF EXEMPLARY EMBODIMENTS

Figure 1:
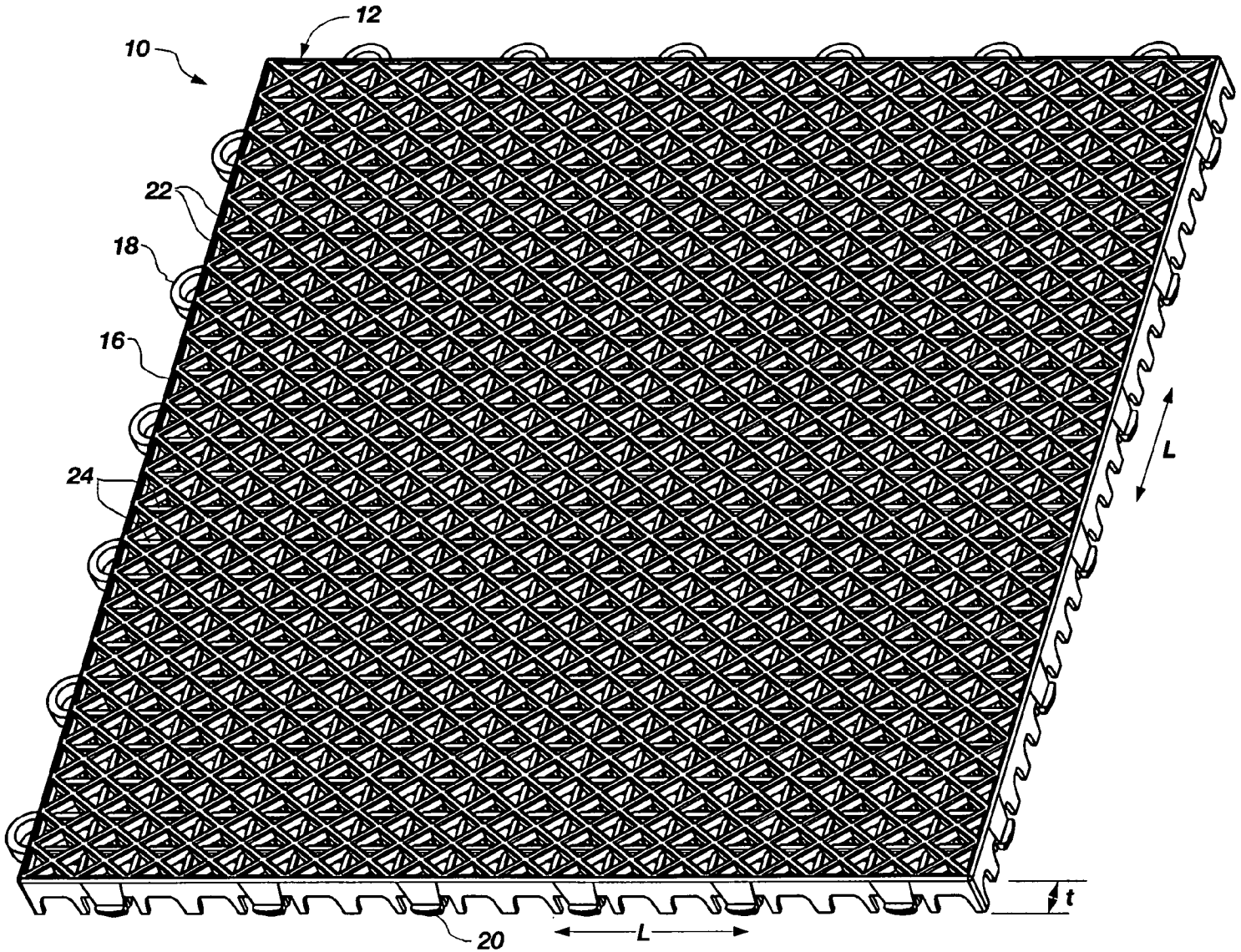
FIG. 1 illustrates a top perspective view of a polymeric floor tile having a multiple-level surface in the form of a bi-level grid surface configuration according to one exemplary embodiment of the present invention.

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention, as represented in FIGS. 1 through 9, is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

The present invention describes various embodiments of a flooring assembly or system comprising a multiple-level surface or surface configuration, such as a bi-level or tri-level surface, or even combinations of these interspaced throughout the floor surface.

The present invention multiple-level surface floor tile provides several advantages over prior related floor tiles. First, a floor tile having a multiple-level surface configuration provides improved water drainage. Due to the staggered surface design, and in accordance with various laws of nature, any water accumulating on the floor tile will fall from the upper surface to one of the lower surfaces, thus leaving the top surface (the contact surface) relatively free from water. This helps to maintain good traction and to prevent slipping. Second, a multiple-level surface configuration is better able to receive or absorb and distribute or otherwise handle lateral forces since these forces may be absorbed and distributed throughout a greater portion along the thickness of the floor tile. Third, the several surfaces may be formed of different material for one or more reasons. For example, since only the contact surface (the uppermost surface receiving contact from a user or object) must comprise good traction and other properties, the lower surfaces out of contact with those using the floor, may be constructed of any type of material and may comprise any type of design.

Each of the above-recited advantages will be apparent in light of the detailed description set forth below, with reference to the accompanying drawings. These advantages are not meant to be limiting in any way. Indeed, one skilled in the art will appreciate that other advantages may be realized, other than those specifically recited herein, upon practicing the present invention.

Modular interlocking floor tiles come in a variety of configurations. Various views of a multiple-level surface floor tile in accordance with one exemplary embodiment of the present invention are shown in FIGS. 1-6 and described below, wherein the floor tile comprises a bi-level surface configuration. As specifically mentioned herein, the present invention contemplates a floor tile having a top surface formed of more than two levels, such as in the case of a tri-level surface configuration or a quad-level surface configuration. As such, although preferred, the present invention floor tile is not limited to a bi-level surface configuration.

Figure 2:
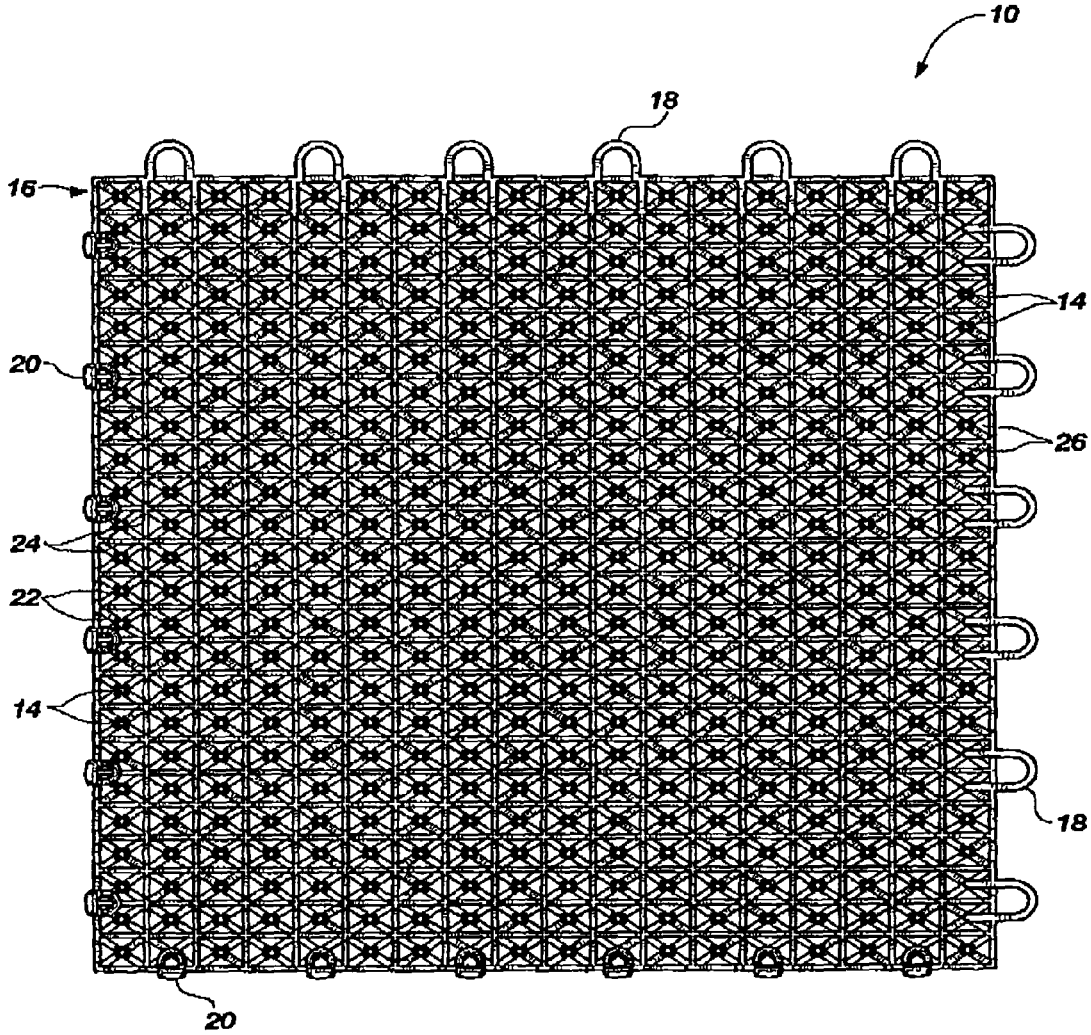
FIG. 2 illustrates a bottom view of the exemplary floor tile of FIG. 1, showing the bottom side and the various support structure for supporting the multiple surface configuration above a floor or subfloor support.
Figure 3:
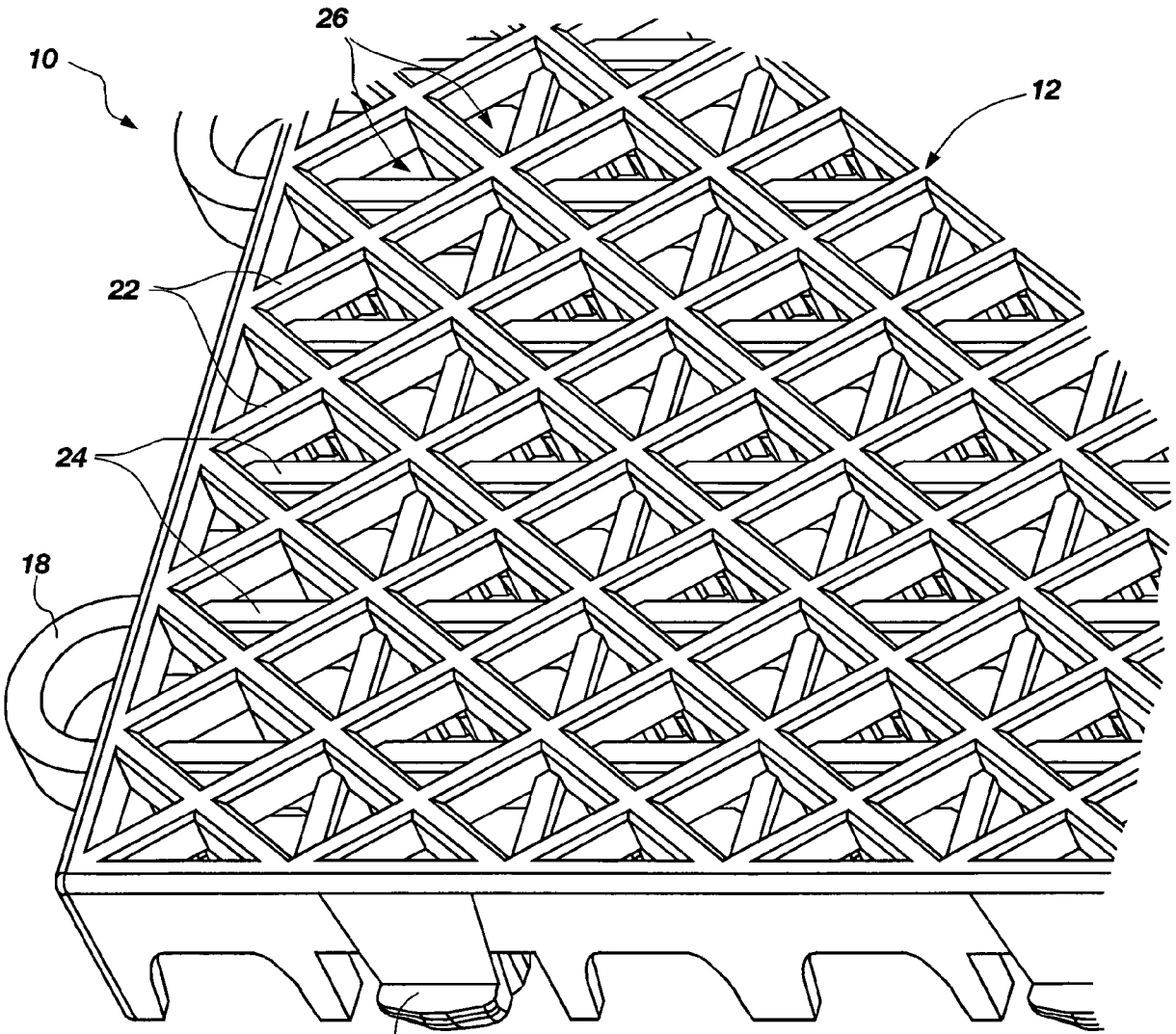
FIG. 3 illustrates a detailed top perspective view of the exemplary floor tile of FIG. 1.

With reference to FIGS. 1-3, illustrated is a perspective view of a modular floor tile having a bi-level surface configuration according to one exemplary embodiment of the present invention. Like other polymeric floor tiles, the present invention multiple-level surface floor tile is approximately square in plan, with a thickness T that is substantially less than the plan dimension L. Tile dimensions and composition will depend upon the specific application to which the tile will be applied. Sport uses, for example, frequently use tiles having a square configuration with a side dimension L of either 9.8425 inches (metric tile) or 12.00 inches. However, it will be apparent that other shapes and dimensions can be used. The thickness T can range from as little as about ¼ inch to 1 inch and beyond, though a ¾ inch thickness is considered a good practical thickness for a tile such as that depicted in FIG. 1. Other thicknesses are also possible. The tiles can be made of many suitable materials, including polyolefins such as polypropylene, polyurethane and polyethylene, and other polymers, including nylon.

As shown, the top of the tile 10 provides a grid surface 12, and the bottom is comprised of a plurality of upstanding supports 14, which gives strength to the tile while keeping its weight low. The tile includes a perimeter wall 16 supporting the top surface and enclosing a perimeter boundary for the tile. A plurality of coupling elements in the form of loop and pin connectors are disposed along the perimeter wall, with loops 18 disposed on two contiguous sides, and pins 20 disposed on the other two contiguous sides. The loop and pin connectors are configured to allow interconnection of the tile with similar adjacent tiles, in a manner that is well known in the art. It is also contemplated that other types of connectors or coupling elements may be used other than those specifically shown herein.

In the exemplary embodiment shown, the floor tile 10 comprises a grid-type top surface 12 having a bi-level surface configuration comprised of first and second surface levels. The first level comprises a lower lattice 24 and the second surface comprises an upper lattice 22, as shown. The lower lattice 24 is oriented generally transverse to the upper lattice 22, so as to provide additional strength to the top surface. The upper and lower lattices 22 and 24 are integrally formed and provide a grid extending within the perimeter wall 16 with drainage gaps 26 therethrough (see FIGS. 3 and 5). The drainage gaps 26 can have a minimum dimension selected so as to resist the entrance of debris, such as leaves, tree seeds, etc., which could clog the drainage pathways below the top surface of the tile, yet still provide for adequate drainage of water.

With reference to FIGS. 1-3 and 5, advantageously, the lower lattice 24 has a top surface 28 that is below a top surface 29 of the upper lattice 22, so as to draw residual moisture below the top surface 29 of the upper lattice 22. Specifically, the surface tension of water droplets naturally tends to draw the droplets down to the lower lattice 24, so that if drops hang in the drainage openings 26, they will tend to hang adjacent to the lower lattice 24, rather than the upper lattice 22, thus reducing the persistence of moisture on the top grid surface, making the surface usable sooner after wetting, and thus providing improved traction along the top surface 29, which functions as the contact surface for those using the flooring assembly. The lower lattice or lower surfaces also functions to break the surface tension, thus facilitating the drawing of the water to the one or more lower surfaces.

In one embodiment, the top surface 28 of the lower lattice 24 is disposed about 0.10 inches below the top surface 29 of the upper lattice 22. The inventors have found this dimension to be a practical and functional dimension, but the tile is not limited to this. In the embodiment depicted in the figures, the upper lattice 22 and lower lattice 24 have a substantially coplanar lower surface 30, with the upper lattice 22 thus comprising a thickness that is about twice that of the lower lattice 24.

The upper lattice 22 comprises elongate structural elements disposed generally diagonally with respect to the perimeter wall 16. The lower lattice 24 comprises elongate structural elements disposed generally parallel to two sides of the perimeter wall 16. The upper lattice 22 comprises two sets of cris-crossing or intersecting structural elements, and the lower lattice 24 also comprises two sets of cris-crossing or intersecting structural elements.

With reference to FIGS. 1-5, the floor tile 10 further includes a support structure, configured to support the tile about a support surface or support floor 32, such as a floor made of concrete, asphalt, etc., or a synthetic subfloor support, and to provide drainage pathways 34 beneath the top surface. As shown in the figures, the support structure comprises discontinuous upright posts 14, configured to support the top surface 12, while providing the drainage pathways below. In the embodiment shown, the upright posts 14 have a generally star-shaped configuration, as known in the art, but other shapes can be used. The upright supports 14 can be disposed at substantially all intersections of the crisscrossing elements of the upper lattice 22, thus providing solid support while not interfering with drainage.

The floor tile 10 can be completely integrally formed of a common material in an injection molding process, so as to be structurally strong. Materials that can be used include polypropylene, polyethylene, polyurethane, nylon, etc. In appropriate formulations, these materials can provide adequate strength, durability, and resilience to withstand vigorous use and outdoor weather conditions. Various additives, such as UV inhibitors, colors, etc. can also be added to the polymer material to increase its suitability to outdoor use.

In some aspects, the floor tile 10 can be configured with the upper lattice 22 formed or constructed of a different material than the lower lattice 24, the upright supports 14, and the perimeter wall 16. As noted above, polymer materials that have adequate strength and durability for use in outdoor sport floors, such as polypropylene, can tend to become smooth with age and wear, thus providing less traction for users. Conversely, polymer materials that provide better traction, even with wear (such as those with higher rubber content), generally do not have sufficient strength and durability for forming these tiles. Accordingly, in one embodiment, the upper lattice 22 can be of a more resilient polymer material (e.g. one having a high rubber content) to provide better traction for users. For example, where the lower lattice and the support structure are of relatively rigid polypropylene, the upper lattice can be of a polypropylene copolymer having a higher proportion of rubber-type material (e.g. ethylene). In this embodiment, the lower lattice, upright supports, and perimeter wall are of a first material, and the upper lattice is of a second material having more resilience and providing more traction than the first.

Other material combinations can also be used. Nevertheless, even when the upper lattice 22 is of a material different from the remainder of the tile 10, the tile 10 can be injection molded as an integral unit via a co-injection process. In such a process, two differing materials can be injected into the same mold to form a single item with differing properties. In the example given, the bond between the two different materials is secure in part because the materials are of the same species, allowing the polymers to cross-link across the material boundary. Nevertheless, polymer materials of different species can also be co-injected in the same manner. During injection molding, polymer materials of two different species will also bond because of the high temperatures and the molten state of the injected material.

Figure 4:
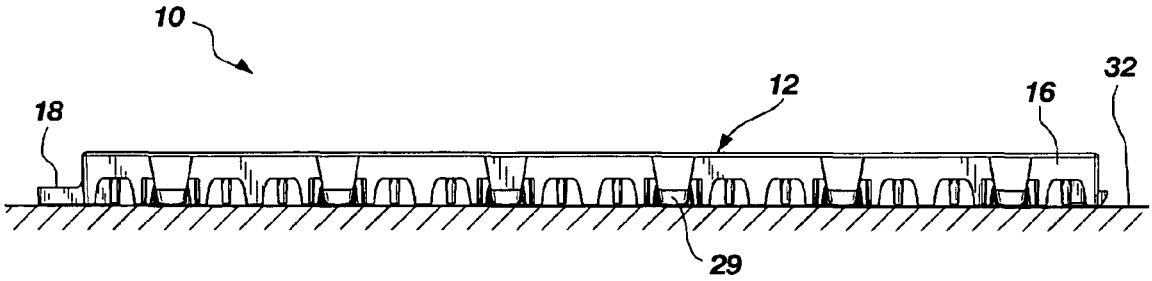
FIG. 4 illustrates a side edge view of the exemplary floor tile of FIG. 1.
Figure 5:
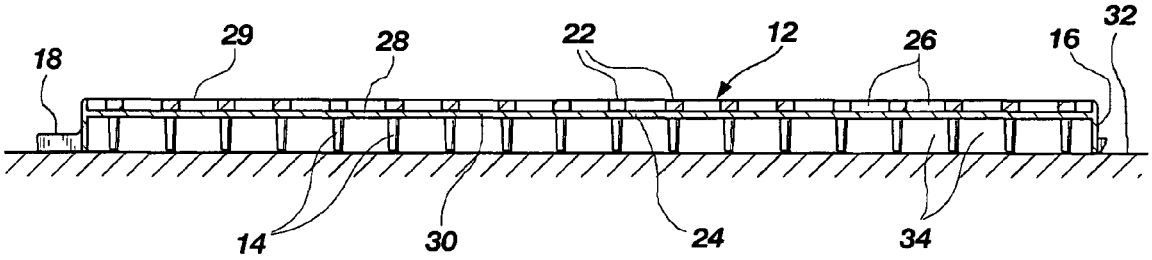
FIG. 5 illustrates a side cross-sectional view of the floor tile of FIG. 1, showing the different levels of the bi-level grid surface configuration, as well as the bottom side supports.
Figure 6:
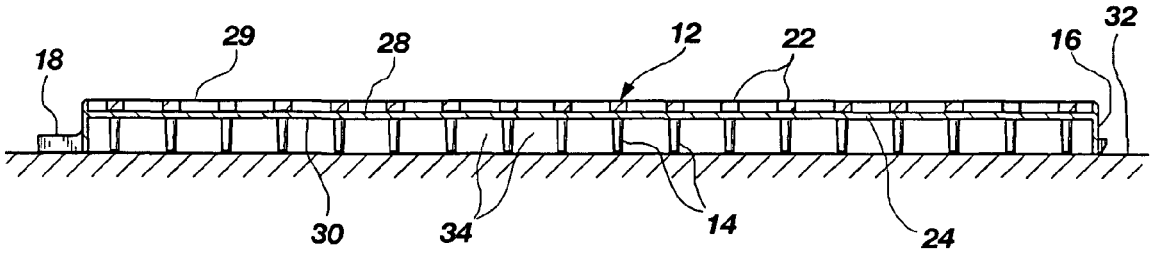
FIG. 6 illustrates a side cross-sectional view of an alternative floor tile with bi-level grid surface, having a two-part top grid surface.

As shown in FIGS. 4-6, an outdoor activity court utilizing the floor tile described herein, would comprise a plurality of such floor tiles coupled or otherwise interconnected together to form a flooring assembly disposed atop a support floor or subfloor 32, such as a substantially smooth, solid subsurface (e.g., concrete, asphalt, or the like), or atop a solid or perforated synthetic subfloor or subsurface. The drainage gaps 26 in the grid-type top surface 12 allow drainage through the top surface, and the upright supports 14 allow the drainage to run along the support floor 32 below the top surface 12 of the polymer tiles, to be drawn away from the activity court. Advantageously, because the lower lattice 24 has a top surface 28 that is below the top surface 29 of the upper lattice 22, residual drainage is drawn below the top surface 29 of the upper lattice 22, allowing the top surface 29, which is the contact surface to become dry faster.

Figure 7:
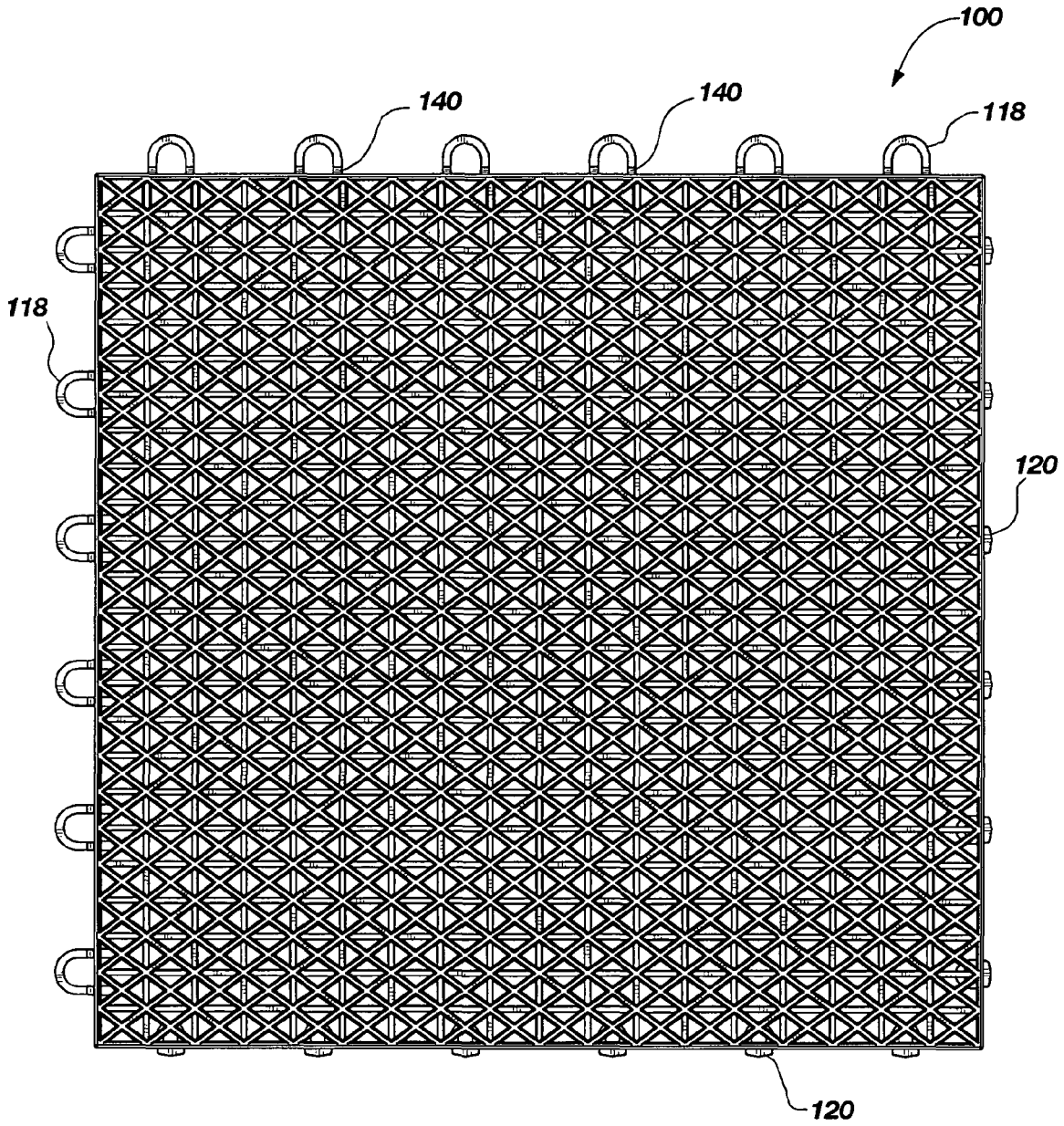
FIG. 7 illustrates a top view of a floor tile having a bi-level grid surface, and loop connectors having a reinforcement member.
Figure 8:
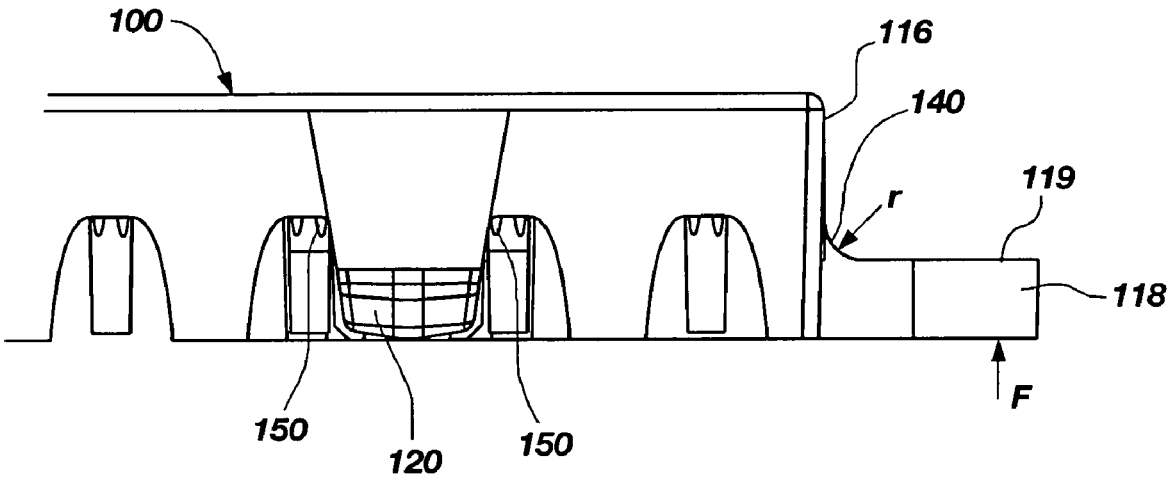
FIG. 8 illustrates a partial detailed side view of the floor tile of FIG. 7 depicting the reinforcement member of the loop connector, according to one exemplary embodiment.
Figure 9:
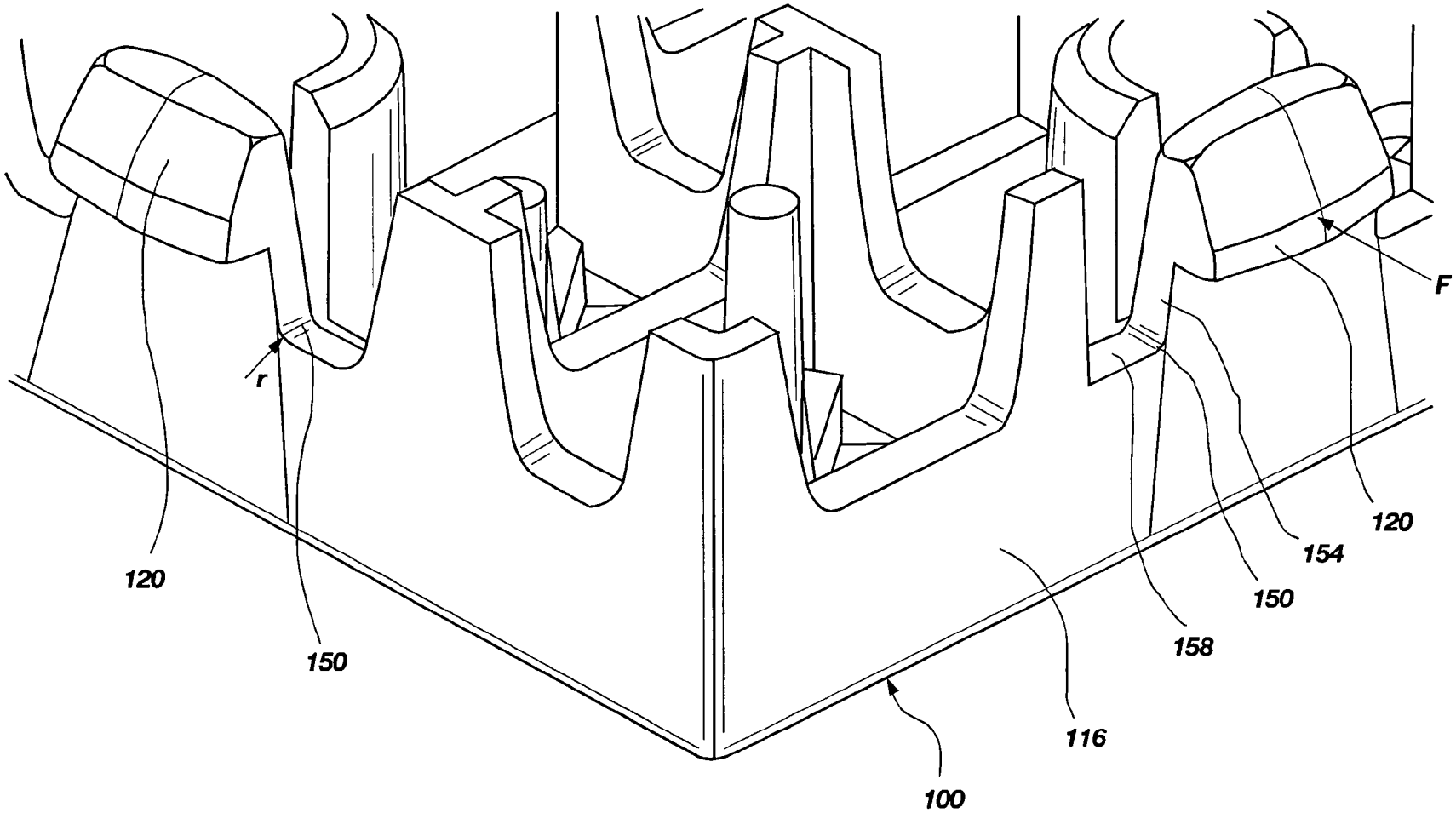
FIG. 9 illustrates a partial detailed side view of the floor tile of FIG. 7 depicting a reinforcement member of the pin connector, according to one exemplary embodiment.

FIGS. 7-9 illustrate still another floor tile, in accordance with another exemplary embodiment of the present invention. As shown, the floor tile 100 comprises a modular floor tile having a bi-level surface configuration similar to the one described above. The floor tile 100 comprises a plurality of coupling elements in the form of loop and pin connectors disposed along the perimeter wall, with loops or loop connectors 118 disposed on two contiguous sides, and pins or pin connectors 120 disposed on the other two contiguous sides. The loop and pin connectors are configured to allow interconnection of the tile with similar adjacent tiles, in a manner that is well known in the art. However, unlike the floor tile described above in reference to FIGS. 1-6, the floor tile 100 comprises loop connectors 118 having a different configuration. Specifically, each of the loop connectors 118 comprise a reinforcement member 140 configured to reinforce the relationship between the loop connector 118 and the perimeter wall 116 of the floor tile 100, thus increasing the strength of the loop connector 118 to resist various forces applied thereto by an adjacently connected floor tile, or other object. For example, the reinforcement member 140 functions to increase the ability of the loop connector 118 to resist upward forces acting on a lower surface of the loop connector 118, shown as force F. Obviously, although not shown, the reinforcement member 140 will function to resist other forces, such as lateral or torsional forces.

In the embodiment shown, the reinforcement member 140 comprises a protrusion that extends upward from a surface 119 of the loop connector 118 and converges with the perimeter wall 116. The reinforcement member 140, or protrusion, comprises a nonlinear, concave configuration having a radius r. The radius r is typically between 0.01 and 0.02 inches, but may comprise other dimensions depending upon the size of the floor tiles being fitted or coupled together. The reinforcement member 140 may further comprise other configurations, such as a linear protrusion. These may be in the form of an inclined, square, or rectangular protrusion (when viewed from the side as is the reinforcement member of FIG. 8, or taken along a cross-section). The reinforcement member 140 is preferably integrally formed with the loop connector 118 and the perimeter wall 116 (e.g., as part of a mold design). Stated differently, the reinforcement member 140 is preferably formed as a physical part of the floor tile, and particularly the loop connector 118 and the perimeter wall 116, although this is not necessary.

With specific reference to FIGS. 8 and 9, the floor tile 100 comprises a plurality of pin connectors 120 having a different configuration than those described above in reference to FIGS. 1-6. Specifically, pin connectors 120 comprise a reinforcement member 150 configured to relieve or reduce the stress within the pin connector 120 once the floor tile 100 is coupled to an adjacent floor tile or other object. Reinforcement member 150 is configured to provide a less abrupt transition from the pin connector 120 to the perimeter wall 116. By doing so, the reinforcement member 150 functions to receive and better distribute loads acting on the pin connector 120 from various forces, such as force F. The loads acting an the pin connector 120 are spread out a greater distance along the edge of the pin connector 120 as compared to a pin connector having an abrupt transition, as would be the case with a sharp angle. Thus, as the pin connector 120 receives force F, which causes the pin connector 120 to flex inward, the reinforcement member 150 distributes the load from this force along a greater portion of the pin connector 120, thus relieving its stress and increasing its strength and ability to resist the force F.

As shown, the reinforcement member 150 comprises a nonlinear, curved section having a radius r that extends from the edge surface 154 of the pin connector 120 to a bottom surface 158 of the perimeter wall 116. Other configurations are contemplated, such as one or more linear configurations.

By way of example, and without limitation, the present invention can be described as providing a polymer floor tile for forming an outdoor floor covering. The polymer floor tile generally comprises a grid-type top surface, having multiple levels, such as in the case of a bi-level surface, wherein an upper lattice is operable with a lower lattice. The lower lattice is oriented generally transverse to the upper lattice, and the upper and lower lattices are integrally formed and provide drainage gaps therethrough. The lower lattice has a top surface below a top surface of the upper lattice, so as to draw residual moisture below the top surface of the upper lattice. The tile further includes a support structure, configured to support the top surface on a support surface and provide drainage pathways beneath the top surface.

As another example, the invention can be described as providing a polymer floor tile for an outdoor floor covering. The tile includes a perimeter wall, enclosing a perimeter boundary for the tile, and a top surface, having an upper lattice, forming a grid extending within the perimeter wall, and a lower lattice, forming a grid extending within the perimeter wall, oriented generally transverse to the upper lattice. The upper and lower lattices are integrally formed and provide drainage gaps therethrough. The lower lattice has a top surface below a top surface of the upper lattice, so as to draw residual moisture below the top surface of the upper lattice. The tile further includes loop and pin connector structure, attached to the perimeter wall, configured to allow interconnection of the tile with similar adjacent tiles, and a support structure comprising discontinuous upright supports, configured to support the tile on a support surface and provide drainage pathways beneath the top surface.

As yet another example, the invention can be described as providing an outdoor activity court. The activity court generally comprises a substantially solid subsurface, and a plurality of polymer floor tiles, disposed atop the subsurface, interconnected to provide an activity court. A top surface of each tile includes an upper lattice and a lower lattice oriented generally transverse to the upper lattice. The upper and lower lattices are integrally formed and provide drainage gaps therethrough. The lower lattice has a top surface below a top surface of the upper lattice, so as to draw residual drainage below the top surface of the upper lattice. Each tile further includes a plurality of upright supports, integrally formed with each of the polymer tiles, configured to allow drainage along the subsurface below the top surface of the polymer tiles.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given above.

What is claimed and desired to be secured by Letters Patent is:

1. A synthetic floor tile system, comprising:

a substantially planar subfloor;

a plurality of synthetic floor tiles disposed atop the planar subfloor, wherein each of the synthetic floor tiles has top surface oriented parallel to the subfloor and substantially orthogonal to the direction of gravity, wherein each of the floor tiles comprises:

a perimeter wall enclosing a perimeter boundary for the tile; and a top surface having a substantially planar upper lattice that forms a grid extending within the perimeter wall and a lower lattice forming a grid extending within the perimeter wall, wherein the lower lattice is oriented generally transverse to the upper lattice and is disposed beneath the upper lattice so as to draw moisture from the upper lattice to the lower lattice in the direction of gravity and through drainage gaps formed in the lower lattice, wherein said drainage gaps extend from the top surface to a bottom surface of the tile;

wherein the male and female connectors comprise loop and pin connectors, situated about the perimeter wall and configured to facilitate interconnection of the tile with similar adjacent tiles;

where said pin connectors comprise a reinforcement member configured to relieve or reduce stresses therein by distributing loads acting on said pin connector from various forces along a greater portion of said pin connectors;

wherein said reinforcement member comprises a nonlinear curved section having a radius, that extends from an edge surface of said pin connector to a bottom surface of said perimeter wall; and a plurality of male connectors disposed about two sides of the tile and a plurality of female connectors disposed about the other two sides of the tile.

2. The synthetic floor tile of claim 1, wherein said loop connector further comprises a reinforcement member configured to reinforce the relationship between said loop connector and said perimeter wall of said floor tile, thus increasing the strength of said loop connector to resist various forces applied thereto.

3. The synthetic floor tile of claim 2, wherein said reinforcement member is configured to extend between an upper surface of said loop connector and a portion of said perimeter wall.

4. The synthetic floor tile of claim 1, further comprising a support structure comprising discontinuous upright supports, the support structure being configured to support the tile on a support surface and provide drainage pathways beneath the top surface.

5. A method for facilitating the removal and drawing of water from a flooring assembly comprising:

configuring a plurality of synthetic floor tiles about a subfloor substantially orthogonal to the direction of gravity, each of said synthetic floor tiles comprising:

a substantially planar contact surface having a top and a bottom, wherein the contact surface comprises an upper and lower level, each level being integrally formed with one another to provide drainage gaps extending all the way through the contact surface and wherein the lower level is configured to draw moisture captured in an upper portion of the drainage gaps downward and away from said upper portion of the drainage gaps, wherein the upper level comprises a plurality of structural elements that intersect one another and define a portion of the drainage gaps as a plurality of polygonal openings and wherein the structural elements of the upper level comprise a side, a top surface that makes up a portion of the contact surface, and a gradual, transition segment extending from the side to the top surface to provide the floor tile with a contact surface having blunt edges; and interconnecting said plurality of synthetic floor tiles to form a flooring assembly.

6. The synthetic floor tile of claim 5, wherein the blunt transition segment is selected from the group consisting of a beveled transition segment, a rounded transition segment edge having a radius, a chamfer, and any combination of these.

7. The synthetic floor tile of claim 5, wherein the lower level has a top surface located above a bottom surface of the upper level.

8. The synthetic floor tile of claim 5, further comprising a support structure having a plurality of upright posts integrally formed with the contact surface and extending downward from the contact surface.

9. The synthetic floor tile of claim 8, wherein at least some of the plurality of upright posts are formed only with the upper level of the contact surface.

10. The synthetic floor tile of claim 8, wherein at least some of the plurality of upright posts are configured with ends terminating at different elevations, such that the at least some of the upright posts are configured to engage a support surface only after a suitable force is applied to the surface of the floor tile.

11. The synthetic floor tile of claim 5, further comprising means for connecting the synthetic floor tile to at least one other floor tile.

12. The synthetic floor tile of claim 5, wherein the upper level comprises a lattice having a plurality of structural elements that intersect one another to define a portion of the drainage gaps as a plurality of polygonal openings.

13. The synthetic floor tile of claim 5, wherein the lower level comprises a lattice having a plurality of structural elements that intersect one another to define a portion of the drainage gaps as a plurality of polygonal openings.

14. A method for forming a flooring assembly comprising:

obtaining a plurality of synthetic floor tiles, each of the floor tiles comprising:

a substantially planar upper level configured to provide an uppermost contact surface wherein the upper level comprises a plurality of structural members that intersect one another to define the drainage gaps as a plurality of polygonal openings and wherein the structural members each comprise a top surface, an edge, and a gradual transition segment extending between the top surface and the edge to provide the floor tile with a contact surface having blunt edges;

at least one lower level disposed in a different elevation from the upper level, the upper and lower levels defining a plurality of drainage gaps in the floor tile, said gaps configured to extend through the upper and lower levels to a bottom portion of the floor tile;

a support system configured to support the upper and lower levels about a support surface;

means for connecting the floor tile to a second floor tile; and interconnecting each of the plurality of synthetic floor tiles atop the support surface to form a flooring assembly, wherein the uppermost contact surface of the upper level is oriented substantially orthogonal to the direction of gravity.

15. A synthetic floor tile comprising:

a top level having a substantially planar upper surface and a bottom surface, the top level comprising a plurality of openings;

wherein structural elements of the top level comprise a side, a top surface that makes up a portion of a contact surface, and a gradual transition segment extending from the side to the top surface to provide the tile with a contact surface having blunt edges;

a rib member disposed within the area formed by said openings, wherein a top surface of each rib member is disposed below the upper surface of the top level of the tile; and a support structure configured to support said top level atop a subfloor.

* * * * *